US010259697B2

(12) United States Patent
Clüsserath et al.

(10) Patent No.: US 10,259,697 B2
(45) Date of Patent: Apr. 16, 2019

(54) FILLING DEVICE

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 16/061,777

(22) PCT Filed: Nov. 14, 2016

(86) PCT No.: PCT/EP2016/077553
§ 371 (c)(1),
(2) Date: Jun. 13, 2018

(87) PCT Pub. No.: WO2017/102196
PCT Pub. Date: Jun. 22, 2017

(65) Prior Publication Data

US 2018/0362317 A1 Dec. 20, 2018

(30) Foreign Application Priority Data

Dec. 16, 2015 (DE) ..... 10 2015 122 032

(51) Int. Cl.

| | |
|---|---|
| ***B67C 3/20*** | (2006.01) |
| ***B67C 3/04*** | (2006.01) |
| ***B67C 3/28*** | (2006.01) |
| ***B67C 3/26*** | (2006.01) |
| *B67C 3/00* | (2006.01) |
| *B67C 3/14* | (2006.01) |

(52) U.S. Cl.
CPC ..... *B67C 3/206* (2013.01); *B67C 3/045* (2013.01); *B67C 3/26* (2013.01); *B67C 3/286* (2013.01); *B67C 3/001* (2013.01); *B67C 3/14* (2013.01)

(58) Field of Classification Search
CPC B67C 3/206; B67C 3/045; B67C 3/14; B67C 3/286; B67C 3/26; B67C 3/001
See application file for complete search history.

(56) References Cited

U.S. PATENT DOCUMENTS

| | | | | |
|---|---|---|---|---|
| 4,434,821 | A | 3/1984 | Bacroix | |
| 2009/0166386 | A1* | 7/2009 | Morand | B67C 3/281 222/559 |
| 2018/0170741 | A1* | 6/2018 | Krulitsch | B67C 3/286 |

FOREIGN PATENT DOCUMENTS

| | | |
|---|---|---|
| DE | 33 25 338 | 1/1985 |
| DE | 10 2013 104938 | 11/2014 |
| DE | 10 2013 106 927 | 1/2015 |

(Continued)

*Primary Examiner* — Timothy L Maust
*Assistant Examiner* — Timothy P. Kelly
(74) *Attorney, Agent, or Firm* — Occhiuti & Rohlicek LLP

(57) ABSTRACT

A valve assembly in a product channel comprises a regulating valve, a filling valve, and an elongated actuation element that is common to both. A filling-valve element that interacts with a filling-valve seat to open and close the filling valve. The regulating valve comprises an actuation element-side regulating valve element that interacts with a regulating-valve seat to control a product quantity to be filled. Both the regulating and filling valve elements are arranged on the actuation element. A driven actuator changes a position of the actuation element relative to the regulating valve seat and the filling valve seat as part of a filling operation.

20 Claims, 7 Drawing Sheets

(56) References Cited

FOREIGN PATENT DOCUMENTS

| | | |
|---|---|---|
| EP | 0 090 664 | 10/1983 |
| EP | 2 915 774 | 9/2015 |
| WO | WO 01/40098 | 6/2001 |

* cited by examiner

FILLING DEVICE

RELATED APPLICATIONS

This application is the national stage entry under 35 USC 371 of international application PCT/EP2016/077553, filed on Nov. 14, 2016, which claims the benefit of the Dec. 16, 2015 priority date of German application 10-2015-122-032.6, the contents of which are herein incorporated by reference.

FIELD OF INVENTION

The present invention relates to a filling device for filling containers with liquids, and in particular, carbonated liquids.

BACKGROUND

A filling device for filling containers with liquid typically has a source of that liquid. The source connects to a channel that ends in a dispensing opening. To fill a container, one places the container below the dispensing opening and operates a valve. By controlling the flow rate through the valve and the amount of time the valve remains open, it is possible to control the total amount of liquid in the container.

SUMMARY

In one aspect, the invention features a filling device having a regulating-valve seat arranged in a liquid channel by way of first and second longitudinally-adjustable elements that are located on regulating-valve seat faces that face away from each other. An example of a longitudinally-adjustable element is a telescopic sleeve. Another example is a gaiter. The gaiter offers the advantage of presenting a smooth and therefore easily cleaned surface towards the product. The two longitudinally-adjustable elements, referred to hereinafter as "gaiters," therefore allow the regulating-valve seat to be axially adjustable and to be arranged in the product channel so as to tightly seal it.

An actuator drive adjusts a distance between the regulating-valve seat and the filling-valve seat. As such, the filling rate and the filling quantity can be adjusted with simplicity and ease. The result is an integrated assembly that allows regulation of the filling rate as well as the opening and closing of the filling valve's outlet in an integrated assembly.

The filling device preferably comprises a flow meter and a controller. The flowmeter is arranged in conjunction with the product channel. The controller operates the actuator drive as a function of a signal from the flow meter. This makes it possible to carry out a volumetric measurement while regulating the filling quantity and filling rate.

Among these embodiments are those in which the flow meter is a magnetically-inductive flow meter that surrounds the product channel. This results in a compact and integrated assembly that allows volumetric measurement for regulating the filling rate and fill quantity as well as for opening and closing the filling valve as necessary.

An annular space surrounding the actuation element forms the product channel. Such a configuration of the product channel is easy to manufacture, for example, by turning. It also promotes both minimal turbulence and high product turnover, particularly when compared to a channel that runs down side of the actuation element.

In some embodiments, the two longitudinally-adjustable elements are configured on either side of the regulating-valve seat as gaiters. Each gaiter preferably forms one section of the product channel's wall. The resulting wall for the product channel is absolutely tight, longitudinally adjustable, and provides essentially no space for harboring bacteria that may contaminate the product.

The first and second gaiter are preferably made of Teflon, PTFE, or polytetrafluorethylene. This material is easy to clean and effectively prevents adhesion of bacteria.

In embodiments that rely on telescopic sleeves, the requirements of hygiene dictate an internal film that would ultimately form a gaiter. Alternatively the gaiters can also be made from another suitable material that is easy to clean. Another example of such a material is stainless steel.

In some embodiments, a valve rod or valve stem forms the actuation element. Such a configuration of the actuation element is easy to manufacture. When used in conjunction with an annular space as the product channel, such an actuation element also results in a homogeneous flow of the product through the product channel with minimal turbulence. It is also easy to move a valve rod axially by engaging its end using a filling machine's guide gate.

In some embodiments, a valve plug, a valve-plug section, or a valve cone forms the regulating-valve element, the filling valve element, or both. In either case, the selected structure is configured on the actuation element and interacts with a wall or edge of the corresponding valve seat to ensure a defined opening and closing and as uninhibited a product flow as possible when the valve is open. Furthermore, the actuation element can also be operated in axial direction by interaction of the regulating-valve seat with the regulating-valve element, i.e. with its plug section. This allows the regulating valve and its actuator drive to be used as an actuator for the axial operating of the actuation element.

In some embodiments, the product supply comprises a collecting vessel arranged at an upper end of the product channel. These embodiments include a sealing collar for connecting the dispensing opening to a mouth of a container that has been placed for filling just below the dispensing opening at the lower end of the product channel. An example of such a container is a bottle.

The sealing collar encloses a sealed-off filling region. At least one return gas channel extends from this filling region to the collecting vessel. In some of these embodiments, a vacuum channel extends from this filling region to a vacuum source. This permits exhaust air that arises when filling the container, especially in the case of carbonated drinks, to easily be drawn off. The result is a rapid and uninterrupted filling operation.

In some embodiments, a spring urges the regulating-valve seat against a stop in an idle position in which the filling valve is open. The regulating-valve seat can then be moved toward the filling valve by the actuation element being actuated by way of the regulating-valve element. In this embodiment of the invention, the actuator for the axial actuating of the actuation element also constitutes the actuator drive for the axial adjusting of the regulating-valve seat relative to the filling-valve seat against the force of the spring. Thus this embodiment of the filling device realizes in a simple way, i.e. without a separate actuator drive for the regulating-valve seat, the adjusting of the filling quantity and filling rate as well as the opening and closing of the filling valve.

In an advantageous embodiment of the invention, the regulating valve interacts with its actuator drive to form the actuator to move the actuation element axially through the interaction of the regulating-valve element and the regulating-valve seat. In this preferred embodiment, no separate actuator is needed for the axial movement of the actuation element as the latter is operated by the actuator drive of the regulating-valve seat when it engages with the regulating-valve element. Therefore only the actuator drive of the regulating-valve seat is necessary to set both the filling rate and filling quantity as well as to open and close the filling valve.

In another embodiment, a spring urges the actuation element into an idle position in which the filling valve is open and the regulating-valve element is arranged axially on the actuation element between the regulating-valve seat and the filling-valve seat. In this case the actuation element can move to close the filling valve by engaging the regulating-valve seat on the regulating-valve element. This makes it possible to set the filling rate and filling quantity through the axial adjustment of the regulating-valve seat in the direction of the product supply. It also makes it possible to open and close the filling valve through axial adjustment in the direction towards or away from the filling-valve seat. This results in an integrated assembly that only requires a single actuator drive to carry out multiple functions.

In other embodiments, the regulating-valve element is arranged axially on the actuation element between the product supply and the regulating-valve seat. In such embodiments, a spring urges the regulating-valve seat against the regulating-valve element when the actuation element is in an idle position in which the filling valve is open. The actuator moves the actuation element toward the product supply or towards the dispensing opening, Movement towards the product supply brings it into a regulating position to regulate product flow by controlling an extent to which the regulating valve is open. Movement towards the dispensing opening ultimately causes the valve to close.

By adjusting the actuation element away from the dispensing opening, the filling quantity and the filling rate can be set, whereas the opening and closing is controlled by moving the actuation element toward the dispensing opening. This embodiment of the invention allows the volumetric measurement and the regulating of the filling quantity and filling rate according to the volumetric measurement while also allowing the opening and closing of the filling valve to control the filling operation.

A feature common to the embodiments described herein is that the valve plugs of the filling valve and of the regulating valve are located on one actuation element. Thus by way of its actuator drive, the regulating-valve seat's position can follow the movement of the filling valve element without losing its regulating function. This results in a filling valve with a high delivery rate and simple construction.

The principle relied upon also functions with a pressure-filling system. In this case, the bottle is pressed up against a filling body and sealed. Such embodiments feature controlled connecting holes from the adapter to the bottle's opening to connect to gas channels.

During filling, the filling valve is open and the regulating valve is in operation. As a result, the position of the regulating-valve seat relative to the regulating-valve element controls the filling rate. When the flowmeter determines that the preselected filling quantity has been reached, the filling valve closes rapidly. To promote such rapid closure, the closing force is strong enough for the regulating-valve element to also be moved downward against the regulating-valve seat.

It is possible to attach different fluid connections. Preferably, these are at the lower end of the product channel. It is then possible to use these additional fluid connections to feed additional fluids into the product channel. For example, it is possible to feed cleaning fluid to clean the filling device. It is also possible to feed hot water to hold the filling device at a high temperature during an interruption of a hot-filling operation.

Some embodiments include guides on the housing. In these embodiments, a vertically-movable lower housing part moves along these guides. Springs support the lower housing on the housing or on the guides such that, when the filling valve closes, the filling-valve seat arranged in the lower housing part cushions the downward motion so that it proceeds more gently. This promotes a rapid and gentle closing of the filling valve. In these embodiments, the lower housing part carries one or more of the filling-valve seat, the dispensing opening, and the flow meter.

In principle the invention can also be used without a flowmeter. For example, instead of a flowmeter, a weighing filler can be used.

BRIEF DESCRIPTION OF THE DRAWINGS

The invention is described below for example with reference to drawings in which.

DETAILED DESCRIPTION

Figure 1:
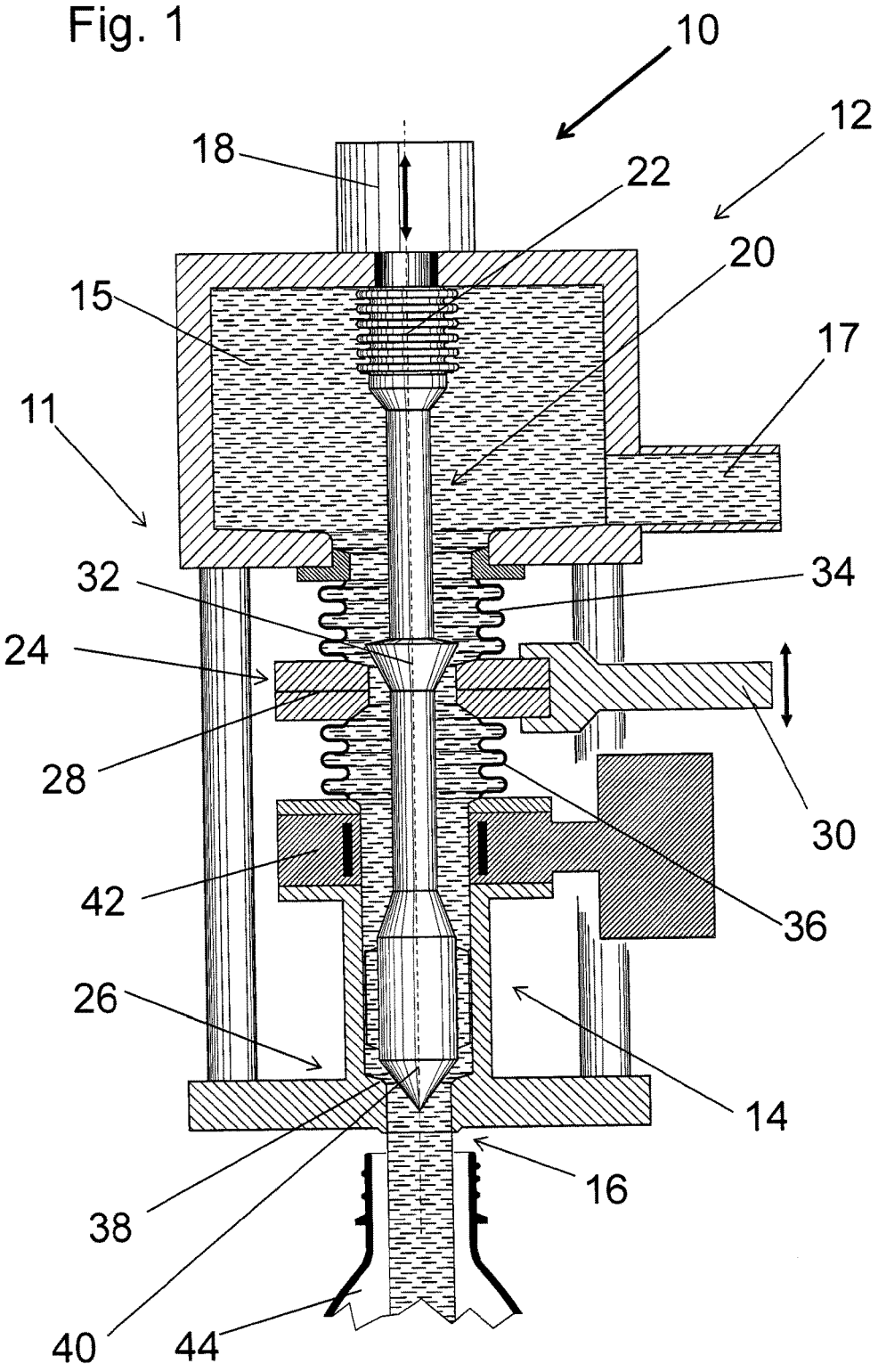
FIG. 1 shows a partial-section vertical side view of a first embodiment of a filling device.

FIG. 1 shows a filling device 10 having a vertically-extending mounting frame 11 at the top of which is held a product supply 12 comprising a collecting vessel 15 into which a product supply-line 17 opens. A product channel 14 extends downward from the product supply 12. At its lower end, the product channel 14 opens out into a dispensing opening 16. A container 44 to be filled lies under the dispensing opening 16.

Arranged within the product channel 14 is an actuation element 20. In some embodiments, the actuation element 20 comprises a valve rod and an actuator 18 that axially adjusts the valve rod. An upper gaiter 22 seals off the valve rod 20 from the collecting vessel 15.

A regulating valve 24 is arranged in the product channel 14 beneath the product supply 12 and upstream from a filling valve 26 at the lower end of the product channel 14.

The regulating valve 24 includes an annular regulating-valve seat 28. An actuator drive 30 adjusts the regulating-valve seat 28 in an axial direction of the actuation element 20. The regulating-valve seat 28 surrounds the actuation element 20 and interacts with a regulating-valve element 32, which in the illustrated embodiment is a valve plug.

First and second gaiters 34, 36 flex as the regulating-valve seat 28 moves up or down. The first and second gaiters 34, 36 define part of the product channel 14. Each of the first and second gaiters 34, 36 has a smooth inner surface that faces the product channel 14 and thus comes into contact with the product. As a result of their smoothness, these inner surfaces promote smoother flow and are easy to clean.

At the lower end of the product channel 14, a filling-valve seat 38 interacts with a filling-valve element 40 that forms a valve plug. These cooperate to form the filling valve 26.

Between the regulating valve 24 and the filling valve 26 is a flow meter 42 that measures the volumetric flow rate through the product channel 14 and provides it to a controller to be used for controlling the actuator drive 30 and hence the product flow when the filling valve 26 is open. In the illustrated embodiment, the flow meter 42 is a magnetic-inductive flow meter In operation, the actuator 18 controls the movement of the valve rod 20. This can be carried out using the filling machine's guide gate. For each filling operation, the flow meter 42 or controller integrates flow to obtain the quantity of product that has been dispensed during that filling operation and provides that measurement to the controller.

The controller compares this measured quantity with a desired value. Based on the result of this comparison, the controller generates a control signal that controls the actuator drive 30. This controls the position of the regulating-valve seat 28 and hence the size of the passage between the regulating-valve element 32 and the regulating-valve seat 28. As a result, it is possible to set the product flow while the filling valve 26 is open.

The filling quantity can always be optimally set to a desired value in this way. The opening and closing of the filling valve 26, i.e. the time-based control of the filling operation, is determined solely by the actuator 18, whereas the product quantity that is dispensed with each filling operation is accurately regulated through the cooperation of the flowmeter 42, the controller, and the actuator drive 30 that it controls. This results in a simple valve design having a high delivery rate and accurate control over fill quantity.

Figure 2:
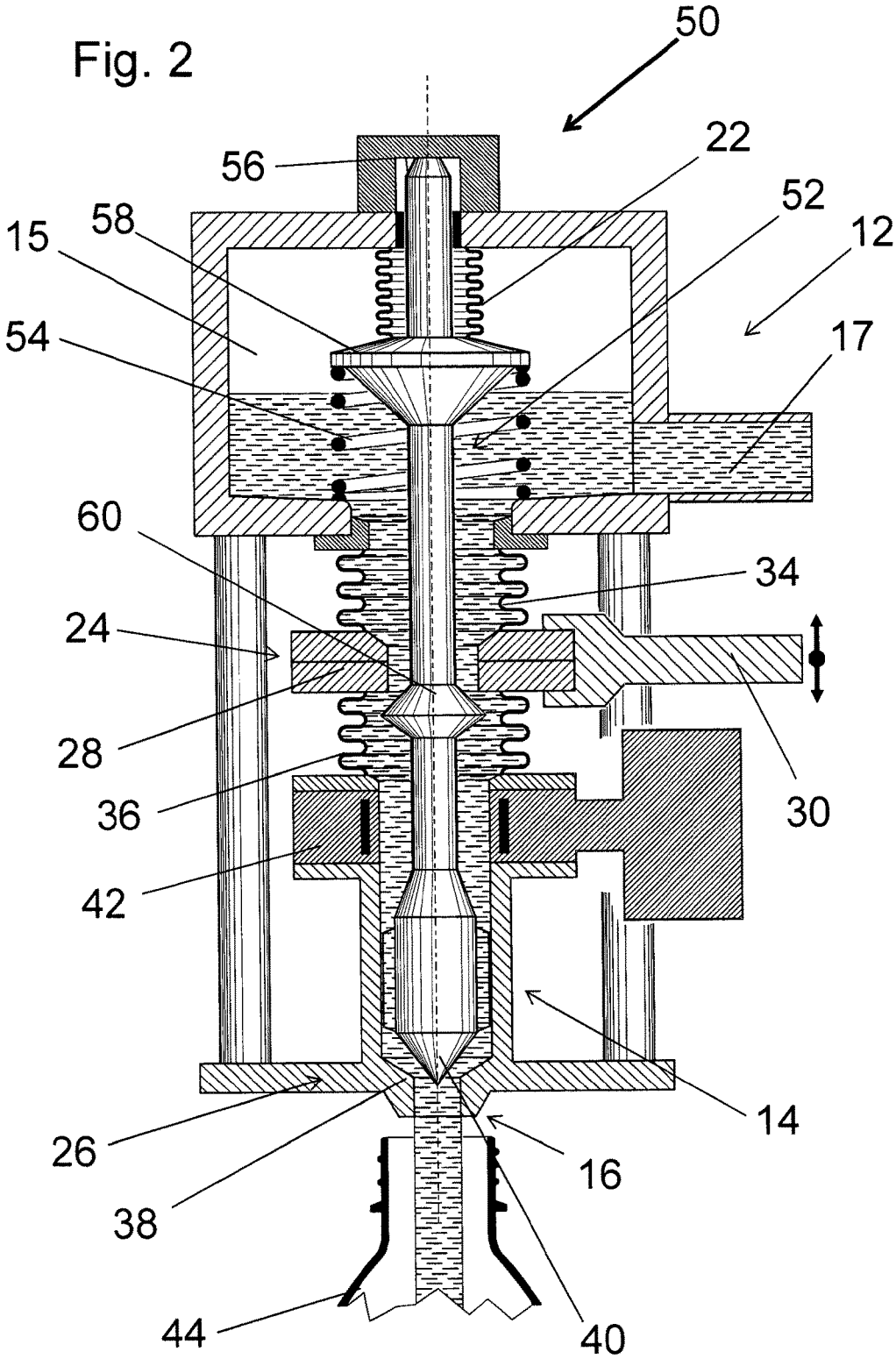
FIG. 2 shows a partial-section vertical side view of a second embodiment of a filling device.

FIG. 2 shows a second embodiment of the invention. In FIG. 2, as well as in all subsequent figures, identical reference numbers identify those parts that are identical or have the same functions.

Unlike the embodiment shown in FIG. 1, no separate actuator 18 controls the valve rod 52 shown in the second embodiment. Instead, a spring 54 extending between the collecting vessel's base and a drive 58 on the valve rod 52 urges the valve rod 52 against an upper stop 56.

In the idle position of the filling device 50, as shown in FIG. 2, the filling valve plug 40 is at a non-zero distance from the filling-valve seat 38. This causes the filling valve 26 to open so that filling can occur.

A regulating-valve plug 60 is arranged beneath the regulating-valve seat 28. As a result, when the actuator drive 30 presses down, the regulating-valve seat 28 presses down on the regulating-valve plug 60. This, in turn, causes the filling valve 26 to close.

In the second embodiment, the actuator drive 30 uses the regulating-valve seat 28 to both set the product quantity and also to close the filling valve. It causes the former by moving the regulating-valve seat 28 upward and causes the latter by moving it downward. Since setting the regulating-valve seat 28 controls both the product quantity and the duration of the filling operation, there is no need for a separate actuator for the valve rod 52. The second embodiment also permits the flow meter's measurement to be used for both regulating the flow rate during a filling operation and also for regulating the duration of that filling operation. As a result, the filling machine no longer needs a guide gate.

Figure 3:
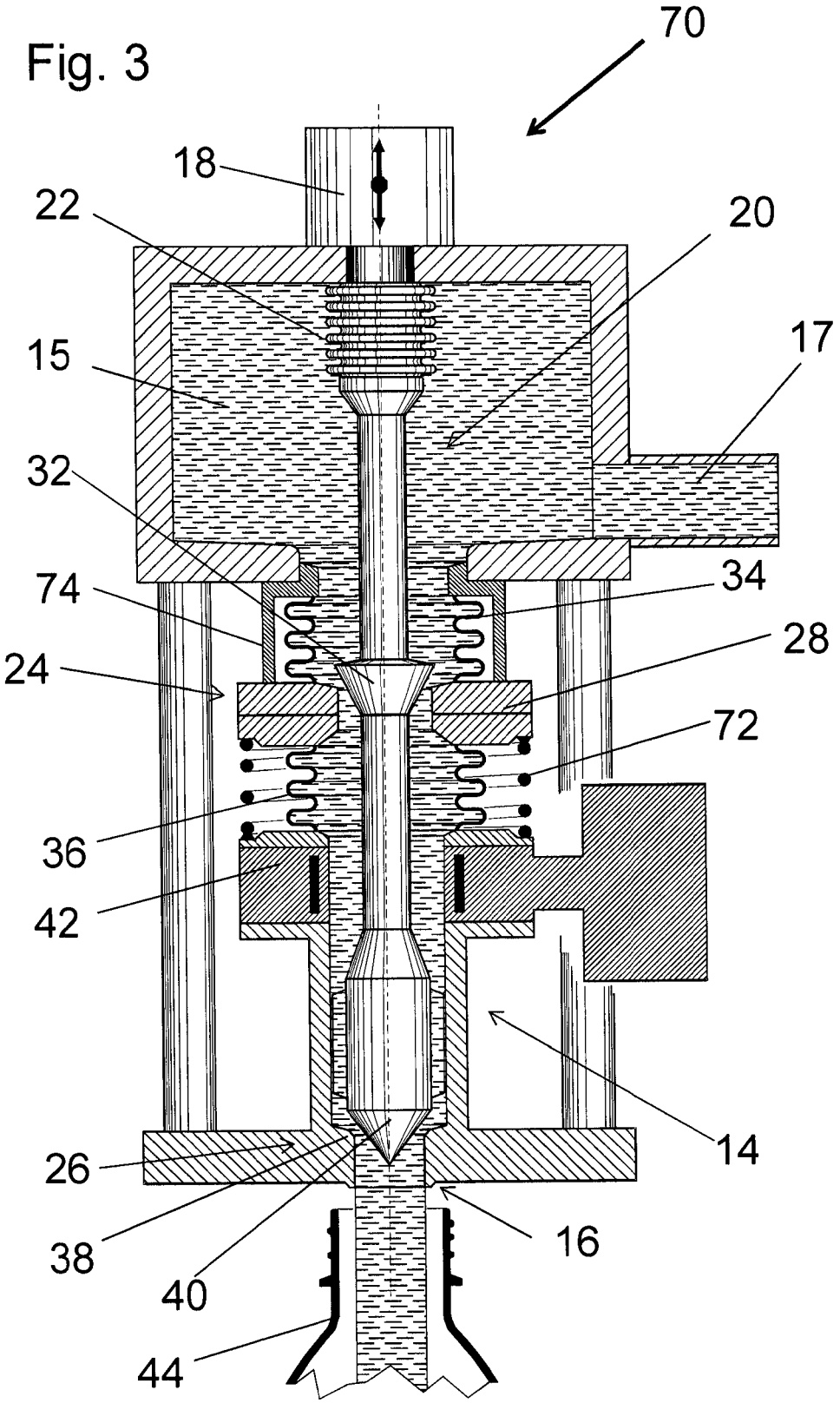
FIG. 3 shows a partial-section vertical side view of a third embodiment of the filling device.

A third embodiment 70, shown in FIG. 3, places a spring 72 between the regulating-valve seat 28 and the flowmeter 42. In this position, the spring 72 urges the regulating-valve seat 28 towards an upper annular stop 74.

The third embodiment 70 permits adjusting the filling quantity upward by having the actuator 18 deflect the valve rod 20.

In this third embodiment, it is possible to adjust the filling quantity upward by having the actuator 18 deflect the valve rod 20. To close the filling valve 26, the valve rod 14 is made to descend so that the filling-valve plug 40 engages the filling-valve seat 38.

In this third embodiment 70, no separate actuator drive is needed to adjust the distance between the regulating-valve seat 28 and the filling-valve seat 38. Instead the axial adjustment of the regulating-valve seat 38 is brought about by having the actuator 18 act against the force of the spring 72.

Figure 4:
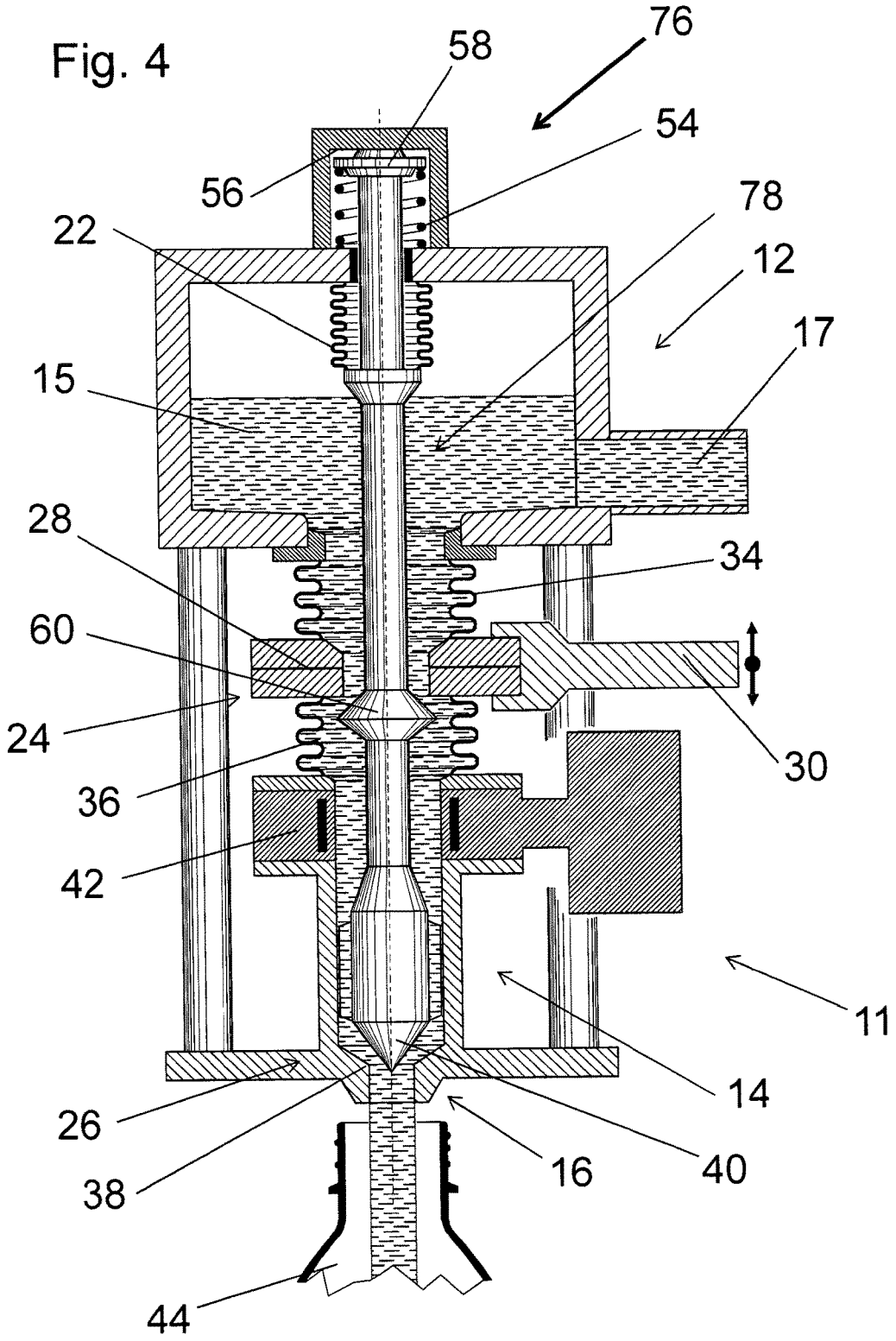
FIG. 4 shows a partial-section vertical side view of a fourth embodiment of the filling device.

FIG. 4 shows a further embodiment of a filling device 76 that is similar to that shown in FIG. 2 but with the valve rod 78 having been modified. In this embodiment, the spring 54 and the driver 58 are above rather than inside the collective vessel 15. The embodiment of FIG. 4 operates in a manner that is essentially the same as that already discussed in connection with FIG. 2.

Figure 5:
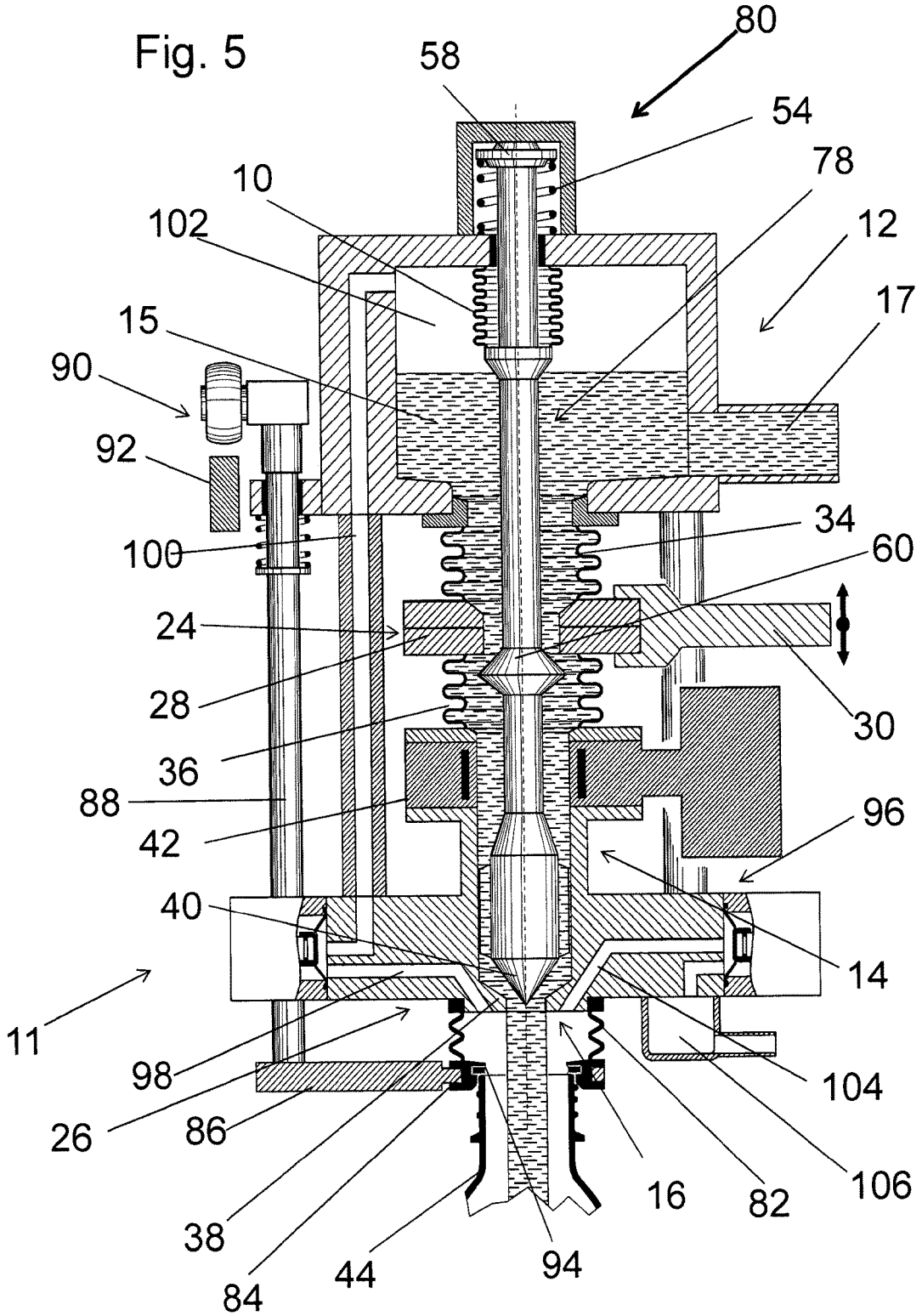
FIG. 5 shows a partial-section vertical side view of a fifth embodiment of the filling device.

FIG. 5 shows a filling device 80 that is largely identical to that shown in FIG. 4 but with the addition of a sealing collar 82 beneath the dispensing opening 16. The sealing collar 82 has a lower sealing-flange 84. A control lever 86, a pushrod 88, and a guide roll 90 cooperate to vertically move the lower sealing flange 84 along the axis of the valve rod 78. A guide gate 92 of the filling machine 80 controls this motion. The control mechanism allows the lower sealing flange 84 of the sealing collar 82 to be set down tightly onto the mouth 94 of a bottle 44 that is to be filled, thus defining a filling space. This makes the filling device 80 particularly useful for pressurized filling of carbonated drinks.

The mounting frame 11 of the filling device 80 comprises a lower reinforced ring plate 96 through which a return gas channel 98 extends. The return gas channel 98 connects a return gas line 100 to an upper part 102 of the collecting vessel 15. A vacuum channel 104 connects the filling space to a vacuum source 106. This permits the vacuum source 106 to intercept gas, including carbon dioxide, that escapes from the bottle 44 during filling. The filling device 80 is controlled as in the case of the filling device shown in FIG. 4.

Figure 6:
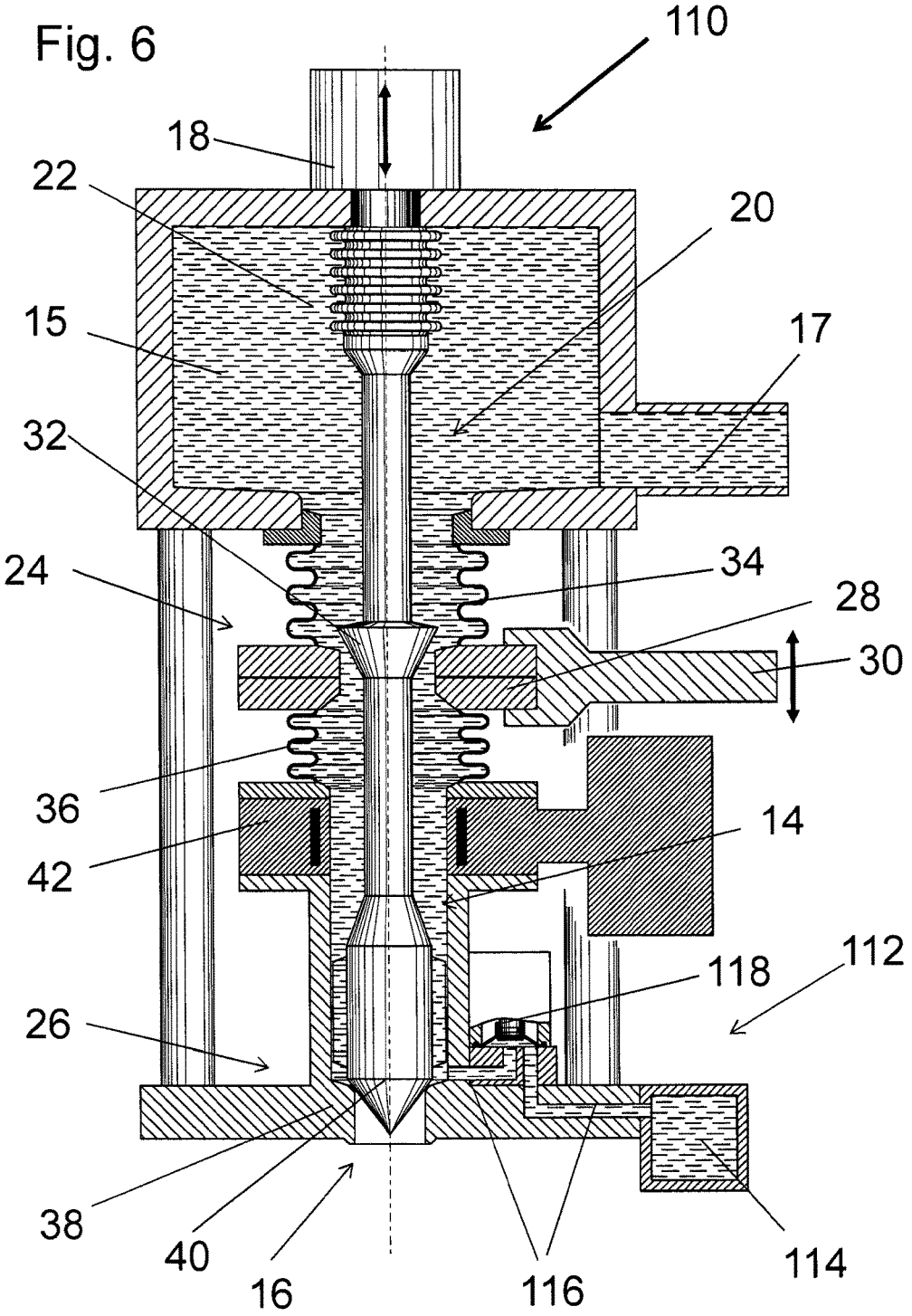
FIG. 6 shows a partial-section vertical side view of a sixth embodiment of the filling device largely in accordance with the third embodiment in FIG. 3.

FIG. 6 shows a sixth embodiment 110 that is similar to that shown in FIG. 3 but with the addition of a fluid connection 112 that comprises a possibly pressurized fluid source 114, a fluid line 116, and a microprocessor-controlled control valve 118 arranged in the fluid line 116. The fluid line 116 extends between the fluid source 114 and the product channel 14.

To clean the filling device, it is possible for the control valve 118 to supply cleaning fluid from the fluid source 114.

In case of an interruption in the filling process, it is possible for the control valve 118 to supply hot water from the fluid source 114 so as to hold the apparatus in the region of the filling valve at a suitable temperature for hot filling.

A plurality of such fluid connections 112 and fluid sources 114 can be arranged in in the filling device so that different fluids, e.g. cleaning fluid and hot water, can be selected and passed through the product channel 14.

Figure 7:
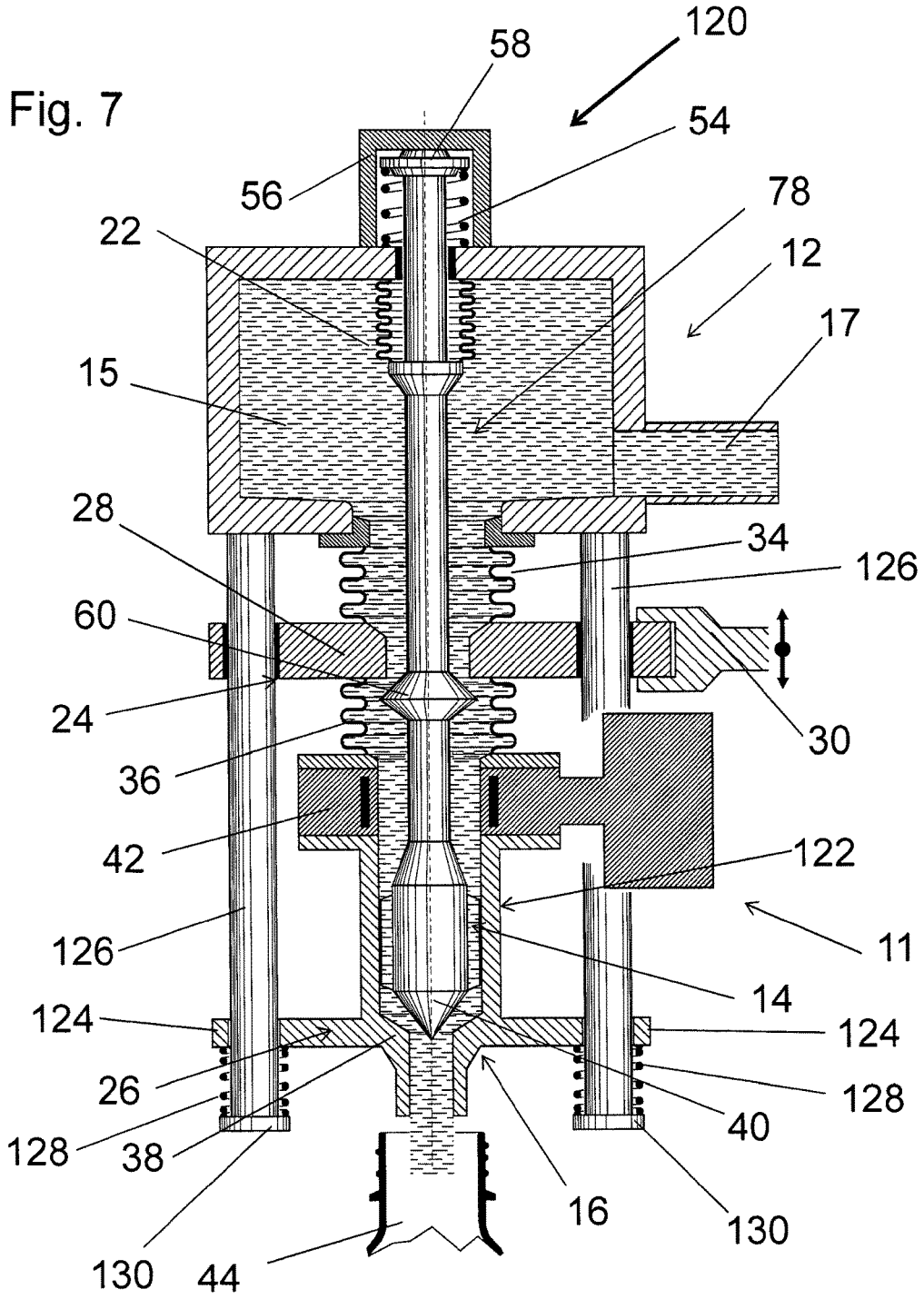
FIG. 7 shows a partial-section vertical side view of a seventh embodiment of the filling device largely in accordance with the fourth embodiment in FIG. 4.

FIG. 7 shows a seventh embodiment 120 that is largely identical to the fourth embodiment according to FIG. 4. In the seventh embodiment, guide rods 126 guide vertical displacement of a lower housing part 122. The lower housing part 122 accommodates the product channel 14 and carries the flow meter 42, the filling-valve seat 38 and the dispensing opening 16.

Springs 128 support the lower housing part on support plates 130 that are attached to the lower end of the guide rods 126. In this way, when the filling-valve element 40 presses down on the filling-valve seat 38 to close the filling valve 28, the filling-valve seat 38 yields downward. This softens the closing operation.

The invention is not confined to the depicted embodiments but is capable of any variation within the protective scope of the following claims.

The invention claimed is:

1. An apparatus comprising a filling device for filling a container with a liquid, wherein said filling device comprises a product supply and a valve assembly that is arranged downstream of said product supply, wherein said valve assembly comprises a regulating valve and a filling valve arranged downstream in a flow direction of said product, wherein said filling device further comprises an elongated actuation-element that is common to said regulating valve and said filling valve, wherein said filling device further comprises a product channel that runs in a longitudinal direction of said actuation element and that extends from said product supply to a dispensing opening of said filling device, wherein said valve assembly is arranged in said product channel, wherein said regulating valve comprises an actuation-element-side regulating-valve element that interacts with a regulating-valve seat in order to control a product quantity to be filled, wherein said filling valve further comprises an actuation element-side filling-valve element that interacts with a filling-valve seat in order to open and close said filling valve, wherein both said regulating-valve element and said filling-valve element are arranged on said actuation element, wherein said filling device comprises at least one driven actuator in order to change a position of said actuation element relative to said regulating-valve seat and said filling-valve seat as part of a filling operation, wherein said regulating-valve seat is arranged in said product channel via at least one of a first and second longitudinally adjustable element, wherein said first and second longitudinally adjustable elements are located on regulating-valve seat faces that face away from each other, wherein a distance from said regulating-valve seat to said filling-valve seat is variable.

2. The apparatus of claim 1, wherein said position of said regulating-valve seat is adjustable by way of an actuator drive.

3. The apparatus of claim 2, further comprising a flow meter that provides a flowmeter signal and a controller for controlling said actuator drive, wherein said controller is configured to operate said actuator drive as a function of said signal.

4. The apparatus of claim 3, wherein said flowmeter comprises a magnetic-inductive flow meter.

5. The apparatus of claim 4, wherein said magnetic-inductive flow meter surrounds said product channel.

6. The apparatus of claim 1, wherein said product channel is formed by an annular space that surrounds said actuation element.

7. The apparatus of claim 1, wherein said first longitudinally adjustable element comprises a first gaiter and said second longitudinally adjustable element comprises a second gaiter.

8. The apparatus of claim 7, wherein said first and second gaiters form part of a wall of said product channel.

9. The apparatus of claim 7, wherein said first and second gaiters comprise polytetrafluoroethylene.

10. The apparatus of claim 1, wherein said actuation element comprises a valve rod.

11. The apparatus of claim 1, wherein at least one of said regulating-valve element and said filling-valve element is formed by a valve plug that is configured on said actuation element.

12. The apparatus of claim 1, wherein said product supply comprises a collecting vessel, wherein a sealing collar is arranged at said dispensing opening for forming a sealed connection between said dispensing opening and a container opening of a container that is to be filled, wherein said sealing collar surrounds a sealed-off filling region from which a return gas channel extends to said collecting vessel.

13. The apparatus of claim 1, wherein a compression spring pretensions said regulating-valve seat onto a stop into an idle position in which said filling valve is open and wherein said regulating-valve seat is movable toward said filling valve by said regulating-valve element.

14. The apparatus of claim 1, wherein said regulating-valve seat, when engaged with said regulating-valve element, forms said actuator to move said actuation element.

15. The apparatus of claim 14, wherein said actuation element is pre-tensioned by a spring into an idle position in which said filling valve is open, wherein said regulating-valve element is arranged on said actuation element between said regulating-valve seat and said filling-valve seat, wherein said actuation element can be moved by said engaging of said regulating-valve seat on said regulating-valve element in closed position of said filling valve.

16. The apparatus of claim 14, wherein said regulating-valve element is arranged on said actuation element between said product supply and said regulating-valve seat and wherein said regulating-valve seat is pre-tensioned by a spring against said regulating-valve element when said actuation element is in idle position.

17. The apparatus of claim 1, wherein said filling device is one of a plurality of filling devices that define a filling machine.

18. The apparatus of claim 17, further comprising a gate control for operating actuators of said filling devices.

19. The apparatus of claim 7, wherein said first and second gaiters comprise stainless steel.

20. The apparatus of claim 12, wherein a vacuum channel extends from said sealed-off filling region to a vacuum source.

* * * * *